United States Patent [19]

Rolf et al.

[11] Patent Number: 4,802,868

[45] Date of Patent: Feb. 7, 1989

[54] CONTACT SPRING CONNECTOR STRIP

[75] Inventors: Helmut Rolf, Feucht; Werner Bock, Kirchensittenbach, both of Fed. Rep. of Germany

[73] Assignee: Leonhardy GmbH, Reichenschwand, Fed. Rep. of Germany

[21] Appl. No.: 114,455

[22] Filed: Oct. 28, 1987

[30] Foreign Application Priority Data

Oct. 29, 1986 [DE] Fed. Rep. of Germany ..... 3636774

[51] Int. Cl.[4] ..... H01R 13/42; H01R 13/506

[52] U.S. Cl. ..... 439/689; 439/733; 439/869

[58] Field of Search ..... 439/682, 686, 688, 689, 439/690, 733, 869

[56] References Cited

U.S. PATENT DOCUMENTS 3,621,444 11/1971 Stein ..... 439/689
4,269,468 5/1981 Ammon et al. ..... 439/733
4,274,699 6/1981 Keim ..... 439/733
4,317,609 3/1982 Lapraik ..... 439/733

FOREIGN PATENT DOCUMENTS 0068393 6/1982 European Pat. Off. .
2431220 1/1976 Fed. Rep. of Germany .

*Primary Examiner*—Gary F. Paumen

[57] ABSTRACT

An improved contact spring connector strip of the type having a housing forming contact chambers and inlets, contact sets in the chambers, and a cover with passageways. The contact sets include springs, which engage stops formed in the inside wall of the housing and have a pair of spring clips, and push-in pins insertable between the clips. Flanges formed on the inside wall separate the clips and extend to ends tapered toward the cover, and have flange end portions with recesses which receive transverse tabs on the push-in pin to firmly support the push-in pin.

17 Claims, 3 Drawing Sheets

CONTACT SPRING CONNECTOR STRIP

FIELD OF THE INVENTION

This invention is related generally to contact spring connector strips of the type having a housing with contacts, each including a contact spring with two facing spring clips and a push-in pin having a connecting end which is inserted into an open-ended contact chamber in the housing to engage the contact spring. Such devices also include at least two opposing tabs at each contact set, each of which, when the contact sets are inserted, is braced against a flange formed on the inside wall of the contact chamber in a position between the spring clips and facing the connecting end of the push-in pin, and a cover which is attachable to the housing to close the connecting side of the contact chambers and has a passageway for each push-in pin.

BACKGROUND OF THE INVENTION

In prior contact spring connector strips of the type mentioned in the introduction, such as those described in EP-A No. 0 068 393 A1, power transmission from the push-in pin to the housing takes place via a base plate, having a contact spring blade with an enlarged portion. Such base plate is welded flush with and at the bottom of the push-in pin, which results in a perpendicular exertion of force. In this situation, the axial stresses of the push-in pins regularly lead to deformation of the base plate and therefore to clearance variations of the contact spring blade.

Similar disadvantages exist in spring connector strips of the type described in the DE-OS No. 24 31 220, in which the contact spring with connector part is wedged at an angle between the cover and the base part. This means, moreover, that the connector part, because of its asymmetric shape, can itself be deformed and right in the area in which it is welded to the contact spring.

OBJECT OF THE INVENTION

It is the object of this invention to improve the typical contact spring connector strip without unnecessary construction expense, so that the power coming from the push-in pins can be carried into the housing in such a way that no deformation of the contact spring blades results.

SUMMARY OF THE INVENTION

The object of this invention is attained in the case of a typical contact spring connector strip by including a recess in each flange facing the connecting end, by having the tabs of the contacts formed on the respective push-in pins, and by having each tab fit into the recess of the respective flange.

It can be seen that the invention is realized when the contacts in the housing or cover are arranged or can be anchored so that they can absorb the force exerted on the housing, and can transform it into compression forces so that the moving parts of the contacts, namely the spring clips, are completely relieved. With this invention, a tool having pins for establishing a connection of the housing with the plate is longer required. Instead, the invention allows connection between housing and plate to be established without complicated tools. In this invention, the forces applied on the housing during connection are absorbed only by the pins, which as a rule are made of a harder and stronger material. Also, the spring clips do not come into contact with any tool, and thus cannot be damaged.

Additional useful and advantageous features of the invention are set forth in the dependent claims.

A preferred feature of the invention relates to the fact that the recesses are open in a direction toward the cover. Provisions may be made such that the recesses are open both toward both the cover and toward the longitudinal axis of the contact chamber. Through such characteristic of the invention it is assured that, even if great pressure were exerted on the housing, it would not lead to displacement or shifting of the plastic material in the area of the recesses. Such displacement and shifting of plastic material is avoided (or minimized) both by the V-shape of the recess-forming flange end and by the fact that the limiting walls of the recesses and the lead portion of the push-in pin form a matching contact. The material simply has no opportunity to escape the recess.

If each side of every recess against which one of the tabs presses is perpendicular to the longitudinal axis of the contact chamber, maximum force between the pins and the contact chamber will result. A further advantageous feature of the invention involves each recess joining a groove, which is formed in the respective inside wall of the contact chamber and runs parallel to such chamber and which extends toward the cover to the housing inlet for such contact chamber. It is useful in this situation for the cross-section of the groove to be offset with respect to the stops. This provision primarily assures good alignment of the contact sets during assembly of the contact spring connector strip.

Each tab having a brace portion extending across the direction of connection and a guide portion extending parallel to the direction of connection, with a rounded transitional area between such portions, assures primarily that there will be no angling of the spring body during assembly of the contact spring connector strip. It is useful if all transitional areas in the tabs are rounded, since the contact sets are made of a considerably harder material than the housing, and minor errors in insertion of the contact sets into the contact chambers can lead to damage of the housing.

For printed circuit boards with particularly voltage-sensitive components, so-called advancing blade contacts are frequently used to deflect undesirable charges. In order that the advancing blades not collide with the pin and thereby damage both parts, the end of the pin facing the blade contact pins can have a recess for advancing blade contact pins, tapering off toward the other end of the pin. This way, manufacturing irregularities in the blade contact pins may also be accommodated.

Finally, the invention provides that the cover have stays with detents which fit into recesses in the housing.

The advantages of this invention relate particularly to the fact that, even with alteration in the interior space of the chamber, construction of the contact spring connector strips is just as simple as construction of contact spring connector strips of the prior art. The most important advantage, however, is that a special tool is no longer needed to establish a connection between the contact spring connector strip and the board.

DETAILED DESCRIPTIONS OF PREFERRED EMBODIMENTS

Figure 1:
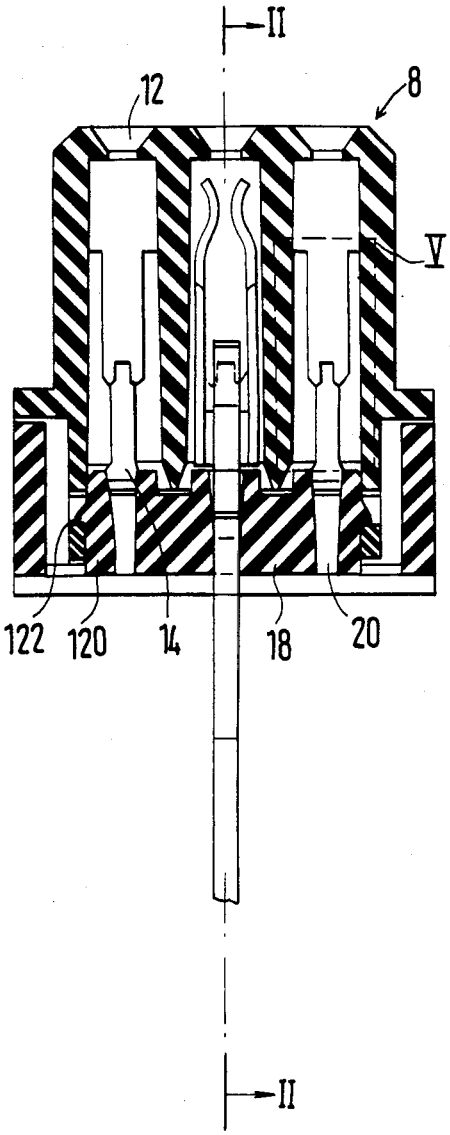
FIG. 1 is a cross-sectional of the contact spring connector strip including a contact set.
Figure 2:
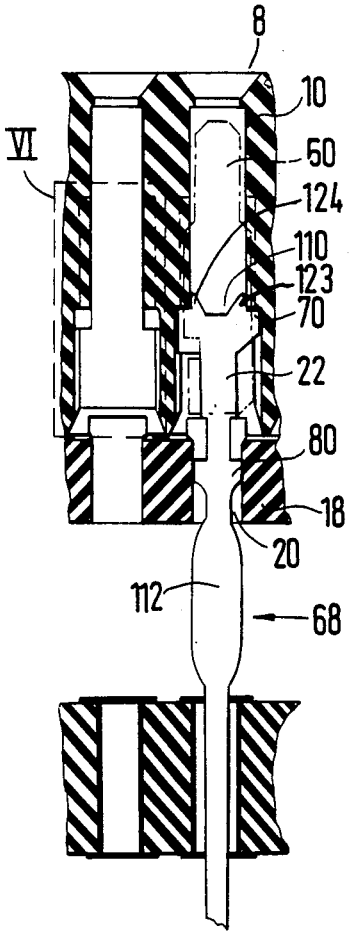
FIG. 2 is a sectional view taken along section II—II, as shown in FIG. 1, together with a board.
Figure 4:
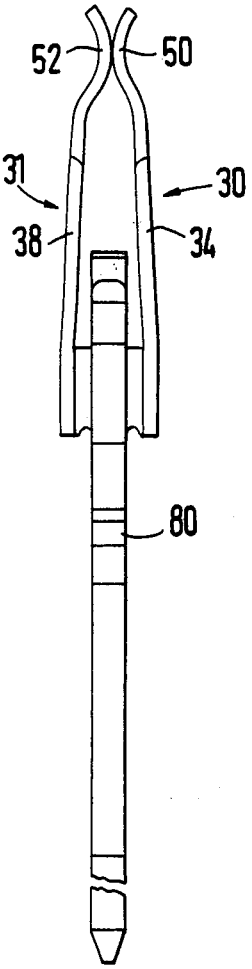
FIG. 4 is a side view of FIG. 3 in the direction of arrow IV as indicated in FIG. 3.
Figure 5:
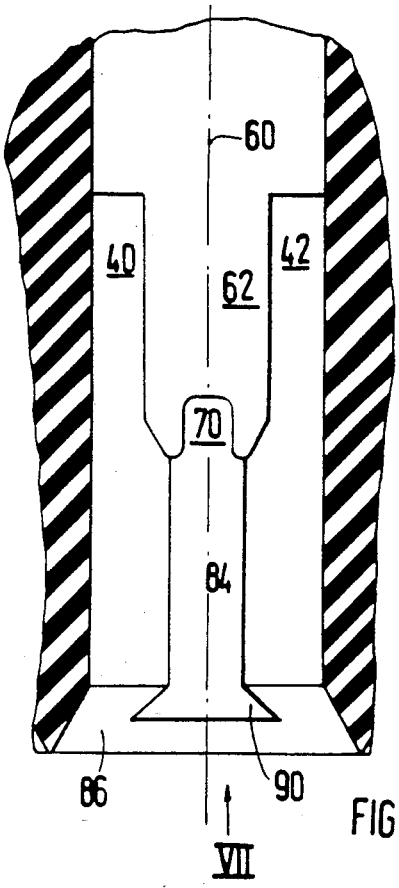
FIG. 5 is a further enlarged view of a portion of the contact chamber, as indicated in FIG. 1 by portion V.

FIGS. 1 and 2 show a portion of a contact spring connector strip having a housing 8, contacts 22 arranged in contact chambers 10, which are formed in housing 8 and have inlets 12,14, and a cover 18 with passageways 20 therethrough. Contacts 22 (see in particular FIGS. 3 and 4) include V-shaped bent springs having two blades 30,31, with guide sections 34,36,38, which work cooperatively with stops 40,42 (see in particular FIG. 5) formed on the inside wall of contact chamber 10 and extending axially. In addition, contacts 22 have spring clips 50,52 which cooperate with blade contact pins of a blade strip (not shown in detail here) and which are kept apart by two flanges 62,64. Flanges 62,64 are arranged respectively between stops 40,42 and project toward longitudinal axis 60 of contact chamber 10. The ends of flanges 62,64 are tapered inwardly at the ends facing cover 18. Contacts 22 also includes a push-in pin 68 which projects from contact chamber 10 and extends through cover 18. The center areas of the ends of flanges 62,64 have recesses 70,71, respectively. Push-in pin 68 of contacts 22 has two pin tabs 74,76, transverse to the longitudinal axis, which fit into recesses 70,71 of flange 62. Blades 30 and 31 are affixed at 69 to one edge of push-in pin 68. The portion of push-in pin 68 engaging cover 18 is an enlarged portion 80, which is tapered outwardly to points toward the insertable free end of push-in pin 68 such that enlarged portion 80 is slightly wider than the width of the passageway 20.

One can see that each recess 70 (and likewise recess 71) is open both toward cover 18 as well as toward longitudinal axis 60 of contact chamber 10. Recess 70 is square in shape such that the side of recess 70 which is engaged by pin tab 74 or 76 is perpendicular to the longitudinal axis 60 of contact chamber 10. Recess 70 is furthermore shaped so that toward cover 18 it joins a groove 84 which is formed in position between, and runs parallel to, stops 40,42 such that groove 84 extends to an inlet 86 of contact chamber 10.

Figure 7:
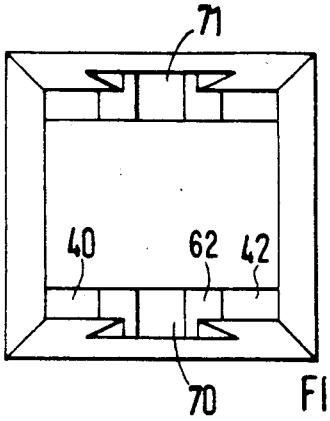
FIG. 7 is another enlarged view of the housing, taken in the direction of arrow VII as indicated in FIG. 5.
Figure 6:
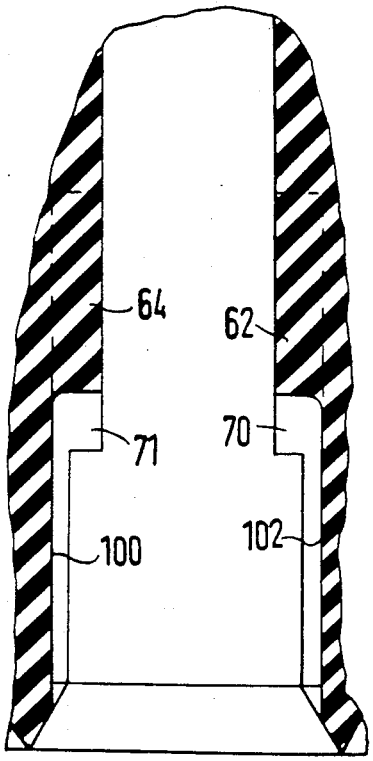
FIG. 6 is an enlarged view of a portion of the contact chamber, as indicated in FIG. 2 by portion VI.

The end of groove 84, formed in inlet 86, has an enlarged portion 90 which facilitates insertion of pin tabs 74,76 into contact chamber 10. In cross-section, groove 84 is laterally offset with respect to stops 40,42. One can see (particularly in FIGS. 6 and 7) that in contact chamber 10 two opposed flanges 62,64 are formed, each with a recess 70,71. Both flanges 62,64 are tapered inwardly toward cover 18 with recesses 70,71 formed at the tapered portion, the ends of which are rounded. When pin tabs 74,76 cooperate with recesses 70,71, there can be no displacement of the material in the area of contact of the pin tabs with the recesses, even under greater pressure exerted on contact spring connector strip 12, since this is hindered by the limiting walls of recesses 70,71 and the preferred lead portion of the push-in pins, in addition to the V-shape of the recess-forming flange ends.

Contacts 22, consisting of two punched parts, has two pin tabs 74,76, whereby the width of contacts 22 in the area of pin tabs 74,76 roughly corresponds to the width of contact chamber 10 in the area of recesses 70,71. This enables the sides of pin tabs 74,76, which extend in a direction parallel to the longitudinal axis of contact 22, to move along walls 100,102 of grooves 84, or recesses 70,71. One can see (particularly in FIG. 3) that pin tabs 74,76 each have a brace portion transverse to the direction of connection and a guide portion running parallel to the direction of connection, with rounded transitional areas 104,106 between such portions. Push-in pin 68 also has an enlarged portion 80 which, being oversized, lodges in cover 18 and thus absorbs a portion of the axial forces during compression to relieve pressure on the bracing portions of pin tabs 74,76.

Figure 3:
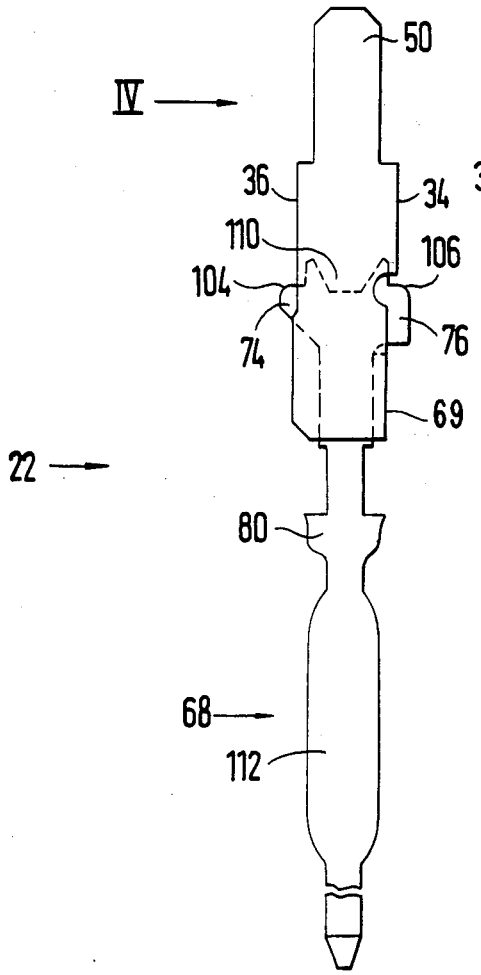
FIG. 3 is an enlarged side elevation of a contact set.

It can furthermore be seen from FIG. 3 that the end of push-in pins 68 which faces the blade contact pins has a recess 110 for advancing blade contact pins, which is tapered inwardly in a direction toward the other end of push-in pin 68.

Push-in pins 68 furthermore have push-in portions 112 the width of which corresponds roughly to the width of passageways 20 in cover 18. Cover 18 has stays 120, pointed toward housing 8, with detents 122 which are detachably connectable with recesses in housing 8.

While the principles of this invention have been described in connection with specific embodiments it should be understood clearly that these descriptions are made only by way of example and are not intended to limit the scope of the invention.

What is claimed:

1. A contact spring connector strip comprising:

a housing forming substantially straight elongated contact chambers which are open at opposite ends, including an inlet end, each chamber having an inside wall forming a pair of opposed inwardly-extending longitudinal flanges within the chamber, each flange having an end within the chamber;

contacts each including a contact spring which has two spring clips facing one another and adapted to rest on opposite sides of the flanges and a substantially flat push-in pin with a connector end insertable into one of the contact chambers, said pin oriented substantially parallel to and between the spring clips and having first and second ends inside and outside the housing, respectively;

the push-in pin having at least two tabs near the first end and positioned to engage the flange ends with the push-in pin inserted, the contact spring being affixed to the push-in pin at a position therealong between the tabs and the second end;

a cover attachable to the housing to close the contact chambers, the cover having a passageway for each push-in pin; and the ends of the pair of flanges within each contact chamber each having a recess facing the direction of insertion of the push-in pin, the recesses positioned and dimensioned to receive said tabs.

2. The contact spring connector strip of claim 1 wherein each recess has a pressure surface normal to the longitudinal direction, said pressure surface being engaged with one of the tabs to receive substantially all of the insertion pressure of the push-in pin.

3. The contact spring connector strip of claim 1 wherein the inside walls also form opposed grooves extending longitudinally from the recesses to the contact chamber inlet.

4. The contact spring connector strip of claim 1 wherein the recesses are open toward the cover.

5. The contact spring connector strip of claim 4 wherein each recess has a pressure surface normal to the longitudinal direction, said pressure surface being engaged with one of the tabs to receive substantially all of the insertion pressure of the push-in pin.

6. The contact spring connector strip of claim 4 wherein the inside walls also form opposed grooves extending longitudinally from the recesses to the contact chamber inlet.

7. The contact spring connector strip of claim 1 wherein the recesses are open both toward the cover and toward the longitudinal axis of the contact chamber.

8. The contact spring connector strip of claim 7 wherein each recess has a pressure surface normal to the longitudinal direction, said pressure surface being engaged with one of the tabs to receive substantially all of the insertion pressure of the push-in pin.

9. The contact spring connector strip of claim 7 wherein the inside walls also form opposed grooves extending longitudinally from the recesses to the contact chamber inlet.

10. The contact spring connector strip of claim 1 wherein each tab has a brace portion transverse to the direction of connection and a guide portion parallel to the direction of connection.

11. The contact spring connector strip of claim 10 wherein each push-in pin has shoulders protruding above the brace portions of the tabs, the shoulders positioned to engage the flanges, respectively, when the brace portions engage the recesses.

12. The contact spring connector strip of claim 10 wherein the brace and guide portions are joined by rounded corners in a transitional area.

13. The contact spring connector strip of claim 12 wherein each push-in pin has shoulders protruding above the brace portions of the tabs, the shoulders positioned to engage the flanges, respectively, when the brace portions engage the recesses.

14. The contact spring connector strip of claim 10 wherein the recesses are open both toward the cover and toward the longitudinal axis of the contact chamber.

15. The contact spring connector strip of claim 14 wherein the inside walls also form opposed grooves extending longitudinally from the recesses to the contact chamber inlet, said opposed grooves receiving the guide portions.

16. The contact spring connector strip of claim 1 wherein each push-in pin, when in the inserted position, has an enlarged portion within the cover passageway, the enlarged portion tapered outwardly to point toward the insertable free end of the push-in pin such that the enlarged portion is slightly wider than the width of the passageway.

17. The contact spring connector strip of claim 1 wherein the cover has stays with detents which fit detachably into recesses within the housing.

* * * * *

UNITED STATES PATENT AND TRADEMARK OFFICE

CERTIFICATE OF CORRECTION

PATENT NO. : 4,802,868

DATED : February 7, 1989

INVENTOR(S) : Helmut Rolf and Werner Bock

It is certified that error appears in the above-identified patent and that said Letters Patent is hereby corrected as shown below:

In column 1, line 63, change "is longer" to --is no longer--.

In claim 16, line 4, change "point" to --points--.

Signed and Sealed this

Thirteenth Day of June, 1989

*Attest:*

DONALD J. QUIGG

*Attesting Officer*

*Commissioner of Patents and Trademarks*